US009675180B2

(12) United States Patent
Currie

(10) Patent No.: US 9,675,180 B2
(45) Date of Patent: Jun. 13, 2017

(54) PORTABLE SOLAR POWERED HEATED SEAT CUSHION

(71) Applicant: Charles N Currie, Marion, AR (US)

(72) Inventor: Charles N Currie, Marion, AR (US)

( * ) Notice: Subject to any disclaimer, the term of this patent is extended or adjusted under 35 U.S.C. 154(b) by 24 days.

(21) Appl. No.: 14/656,757

(22) Filed: Mar. 13, 2015

(65) Prior Publication Data

US 2016/0262543 A1 Sep. 15, 2016

(51) Int. Cl.

| | |
|---|---|
| ***H05B 1/02*** | (2006.01) |
| ***A47C 7/74*** | (2006.01) |
| ***A47C 7/02*** | (2006.01) |
| ***A47C 7/42*** | (2006.01) |

(52) U.S. Cl.

CPC ..... *A47C 7/748* (2013.01); *A47C 7/021* (2013.01); *A47C 7/425* (2013.01)

(58) Field of Classification Search

CPC .. A47C 7/748; A47C 1/14; A47C 4/00; H05B 1/02; H05B 1/0236; H05B 1/0238; H05B 3/0042

USPC ..... 219/217, 212, 494, 505, 544, 545, 549, 219/205, 203

See application file for complete search history.

(56) References Cited

U.S. PATENT DOCUMENTS

| | | | | |
|---|---|---|---|---|
| 7,810,434 | B2 | 10/2010 | Flom | |
| 8,388,056 | B2 | 3/2013 | Smith et al. | |
| 8,430,451 | B1 * | 4/2013 | Heinz | B60N 2/5685 297/180.12 |
| 8,439,437 | B2 | 5/2013 | Akai et al. | |
| 8,492,680 | B2 | 7/2013 | Ohashi et al. | |
| 8,567,861 | B2 | 10/2013 | Matsishima | |
| 2008/0100101 | A1 * | 5/2008 | Wolas | A47C 7/748 297/180.15 |
| 2010/0101621 | A1 * | 4/2010 | Xu | C09K 5/063 136/206 |
| 2015/0001201 | A1 * | 1/2015 | Adler | F24J 2/461 219/213 |

* cited by examiner

*Primary Examiner* — Mark Paschall
(74) *Attorney, Agent, or Firm* — David J Kreher

(57) ABSTRACT

A portable solar powered heated seat cushion wherein the solar cell supplies energy to a heating element inserted into a portable seat cushion to create a heated seat cushion that can be used in the outdoors, especially for use in hunting, fishing and camping and that can be fitted onto existing seats or surfaces.

12 Claims, 14 Drawing Sheets

PORTABLE SOLAR POWERED HEATED SEAT CUSHION

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

DESCRIPTION

Field of the Invention

This disclosure relates to the use of a solar cell that supplies energy to a heating element inserted into a portable seat cushion to create a portable solar powered heated seat cushion that can be used in the outdoors, especially for use in hunting, fishing and camping that can be placed on an existing seat or surface and provide warmth to user for an extended period of time without disturbing the surroundings.

Background of the Invention

Outdoor activities including hunting, fishing and camping may involve extended periods of sitting in the cold. These conditions involve sitting in a tree stand, on a boat, in a fishing shanty, or in a chair next to a camp fire. In these and other instances, it would be nice if a portable heating source were available but generators are loud and heavy, and batteries to power a heating system for an extended period of time are also cumbersome. The present disclosure, a portable solar powered heated seat cushion, is a portable system that can be placed on any seat or surface and provide warmth to user for an extended period of time without disturbing the surroundings.

Several attempts have been made to create heated seats, all of which can be distinguished from the present disclosure:

In U.S. Pat. No. 8,567,861, Matsushima, discloses a built-in heated seat and backrest for a vehicle where the seat in installed in the vehicle, be it an automobile, motorcycle or snow mobile and includes cushions for the seat and backrest, a skin over the seat cushion and backrest, and seat heater, where the system is powered by the vehicle electrical system, whereas the present disclosure reveals a portable seat cushion with or without a back rest, with a heating elements in the cushion, where the heating element is powered by a battery and the battery is charged by a solar cell.

In U.S. Pat. No. 8,492,680, Ohashi et al., discloses a built-in heated seat cushion and backrest for a vehicle where the seat in installed in an automobile that includes cushions for the seat and backrest, a skin over the seat and backrest, and seat heater, where the system is powered by the vehicle electrical system, whereas the present disclosure reveals a portable seat cushion with or without a back rest, with a heating elements in the cushion, where the heating element is powered by a battery and the battery is charged by a solar cell.

In U.S. Pat. No. 8,439,437, Akai et al., discloses a built-in heated seat cushion, backrest and arm rests for a vehicle where the seat in installed in an automobile that includes cushions for the seat and backrest, a skin over the seat and backrest, and seat heater, where the system is powered by the vehicle electrical system, whereas the present disclosure reveals a portable seat cushion with or without a back rest, with a heating elements in the cushion, where the heating element is powered by a battery and the battery is charged by a solar cell.

In U.S. Pat. No. 8,388,056, Smith et al., discloses a heated collapsible article of furniture that includes a chair with a solar-cell attached to the back which is connected to a rechargeable battery, which then supplies power to a heating element within the fabric of the chair. The present disclosure includes a solar-cell that supplies energy to a battery or directly to a heating element, where the heating element is within a cushion, where the cushion can be placed on any portable chair or seating surface and where the solar cell can be placed relative to the sun without moving the seat surface.

In U.S. Pat. No. 7,810,434, Flom, discloses a heated ski lift powered by a solar cell with multiple built in heating elements in the seat, backrest and cross-bar areas, whereas the present disclosure reveals a portable seat cushion with or without a back rest, with a heating elements in the cushion, where the heating element is powered by a battery and the battery is charged by a solar cell.

SUMMARY OF THE INVENTION

The present disclosure is a portable solar powered heated seat cushion comprising a plurality of solar cells, a power storage device, a control unit with a switching means for controlling the flow of electricity, a plurality of heating elements, a seat cushion, where the seat cushion comprises a seat portion or a seat portion and a back rest portion, and where the plurality of heating elements are inserted within the seat cushion.

In a first embodiment of the portable solar powered heated seat cushion, the plurality of solar panels are connected to a control unit by an appropriate electrical cabling, the control unit is connected to the plurality of heating elements by an appropriate electrical cabling, and the plurality of heating elements are inserted into the seat cushion.

In a second embodiment of the portable solar powered heated seat cushion, the plurality of solar panels are connected to a power storage device by an appropriate electrical cabling, the power storage device is connected to a control unit by an appropriate electrical cabling, the control unit connected to the plurality of heating elements by an appropriate electrical cabling, and the plurality of heating elements are inserted into the seat cushion.

The power storage device comprises a rechargeable battery. Said rechargeable battery can be wired in series or in parallel such that, the rechargeable battery can charge from the plurality of solar panels but when electricity is being derived from the plurality of solar panels, electricity flows directly from the plurality of solar cells to the control unit, and only when insufficient or no electricity is being delivered from the plurality of solar cells does electricity come from the rechargeable battery.

The portable solar powered heated seat cushion is operated by a control unit with a switching means to control the flow of electricity wherein one embodiment of the control unit, the control unit comprises an on/off switch. In a second embodiment of the control unit, in addition to the on/off switch, the control unit has a plurality of level control switches, for instance, a low, medium and high, where each level control switch regulates the flow of electricity to the heating element. In a third embodiment of the control unit, in addition to the on/off switch, the control unit comprises a rheostat where the rheostat regulates the flow of electricity to the heating element. In a fourth embodiment of the control unit, in addition to the on/off switch, the control unit comprises a temperature monitoring means, where the temperature monitoring means allows the plurality of heating elements to reach a maximum temperature before shutting off the electricity to the plurality of heating elements and allowing the plurality of heating elements to cool before reactivating the plurality of heating elements, where the temperature monitoring means can be either preset by the manufacturer or manually controlled by the operator through a plurality of temperature control level switches or a temperature control rheostat. Any of the embodiments of the control unit may comprise additional power outlets, such as a usb port.

One embodiment of the seat cushion of the portable solar powered heated seat cushion comprises a seat portion only. A second embodiment of the seat cushion comprises a seat portion and a back portion. A third embodiment of the seat cushion comprises a seat portion, a back portion and a pair of arm portions. A fourth embodiment of the seat cushion comprises a seat portion, a back portion, and a leg portion. A fifth embodiment of the seat cushion comprises a seat portion, a back portion, a pair of arm portions, and a leg portion. Within the seat portion, back portion, pair of arm portions, and leg portion, are the plurality of heating elements.

DETAILED DESCRIPTION OF THE INVENTION

Figure 1:
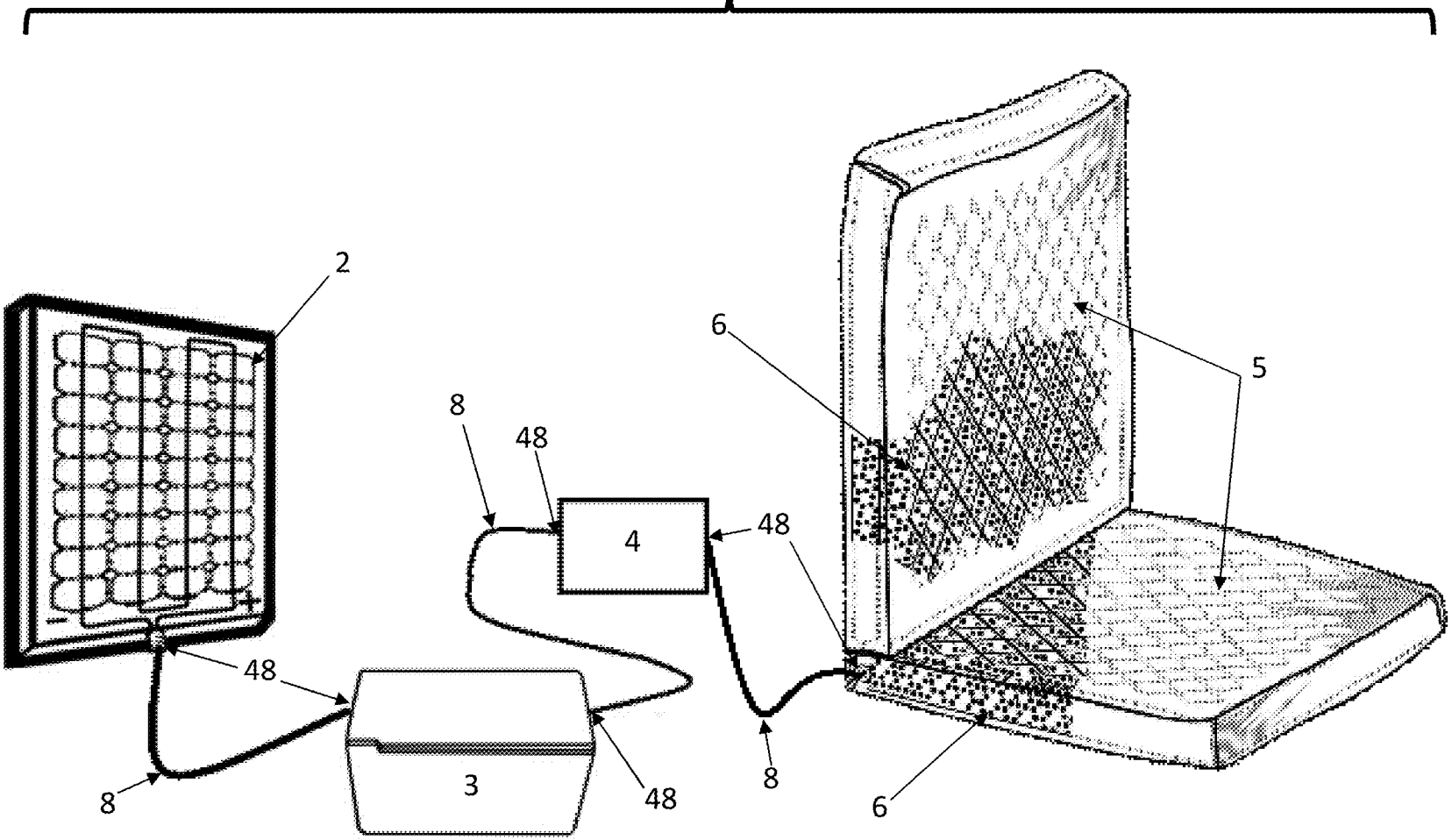
FIG. 1 is a view of the portable solar powered seat cushion with displaying the plurality of solar panels, the power storage device, the control unit, the seat portion and back portion, and the plurality of heating elements contained in the seat portion and back portion.
Figure 2A:
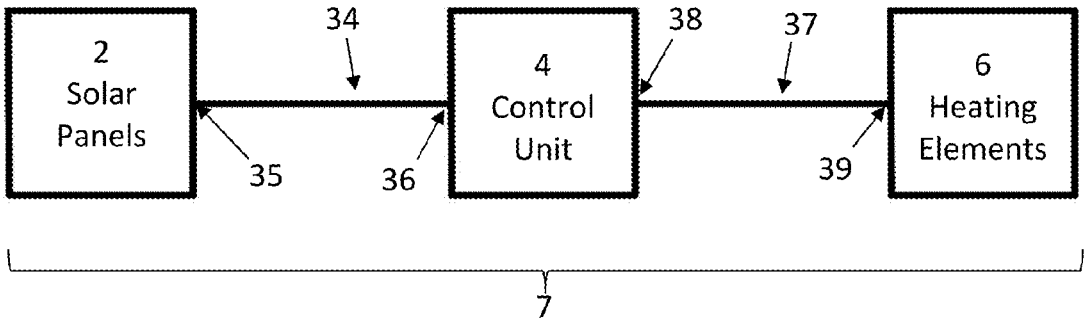
FIG. 2A is one-line diagram of the first embodiment of the portable solar powered heated seat cushion displaying the plurality of solar panels, control unit, seat cushion with a plurality of heating elements.
Figure 2B:
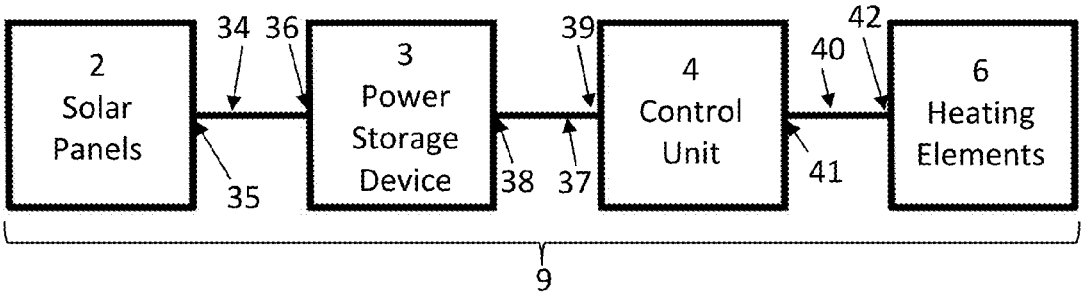
FIG. 2B is one-line diagram of the second embodiment of the of the portable solar powered heated seat cushion displaying the plurality of solar panels, the power storage device, control unit, seat cushion and plurality of heating elements, where the rechargeable battery of the power storage device is wired in series.
Figure 2C:
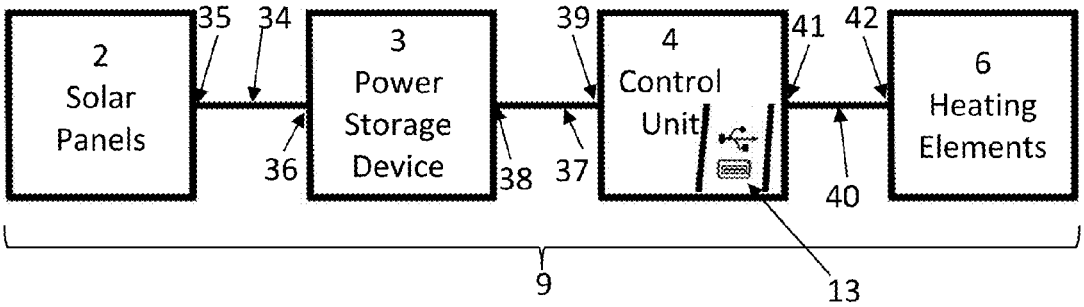
FIG. 2C is one-line diagram of the second embodiment of the of the portable solar powered heated seat cushion displaying the plurality of solar panels, the power storage device, control unit, seat cushion and plurality of heating elements, where the rechargeable battery of the power storage device is wired in series, and where there is a plurality of additional power outlets.
Figure 2D:
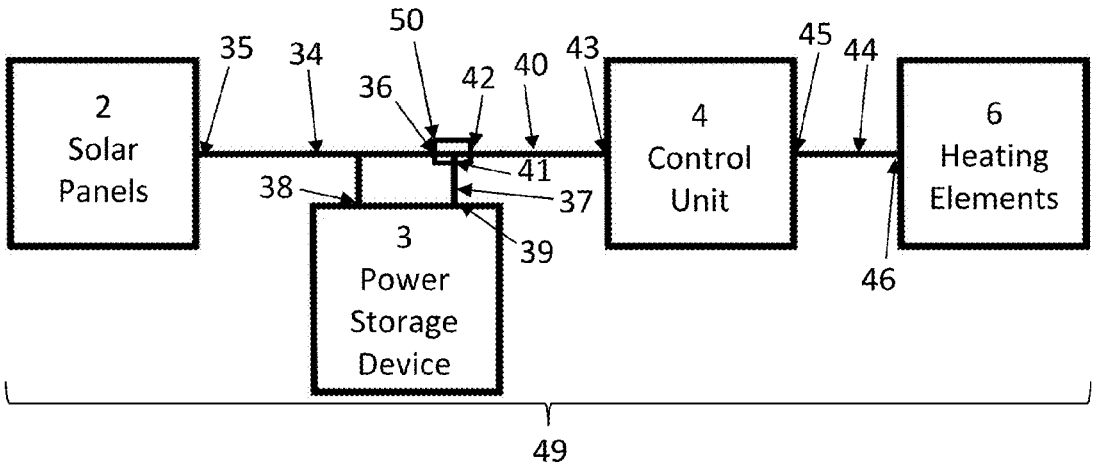
FIG. 2D is one-line diagram of the third embodiment of the of the portable solar powered heated seat cushion displaying the plurality of solar panels, the power storage device, control unit, seat cushion and a plurality of heating elements, where the rechargeable battery of the power storage device is wired in parallel such that the rechargeable battery only supplies power to the control unit when there is insufficient electricity from the plurality of solar panels to power the plurality of heating elements.
Figure 2E:
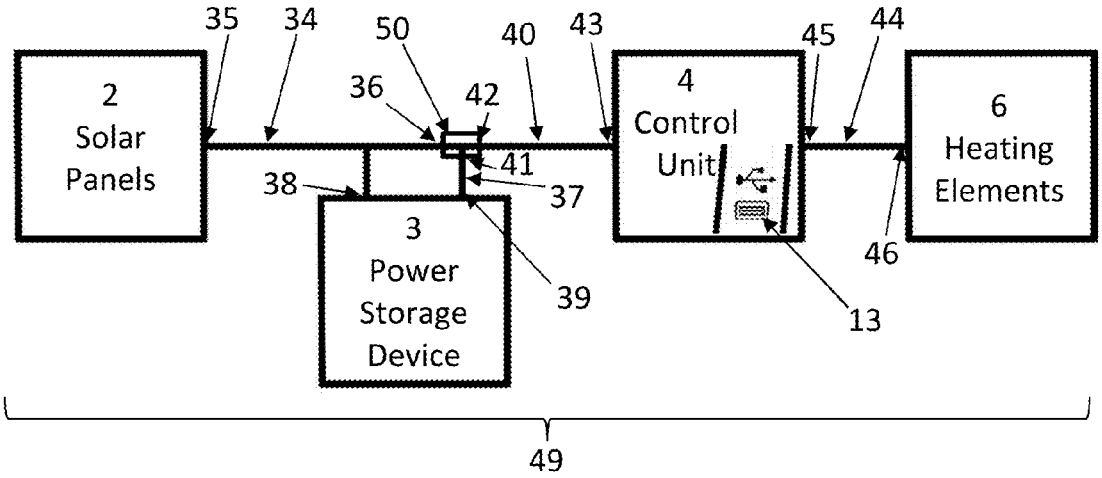
FIG. 2E is one-line diagram of the third embodiment of the of the portable solar powered heated seat cushion displaying the plurality of solar panels, the power storage device, control unit, seat cushion and a plurality of heating elements, where the rechargeable battery of the power storage device is wired in parallel such that the rechargeable battery only supplies electricity to the control unit when there is insufficient electricity from the plurality of solar panels to power the plurality of heating elements, and where there is a plurality of additional power outlets.
Figure 3A:
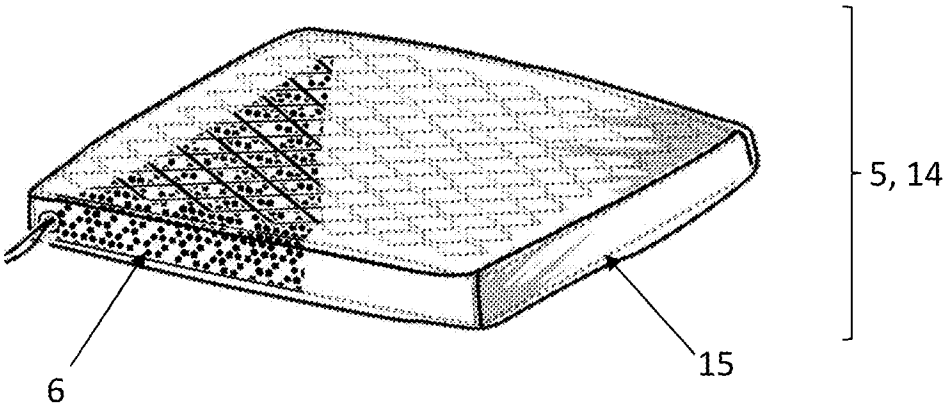
FIG. 3A is a view of the first embodiment of the seat cushion comprising the seat portion, and also displaying the associated plurality of heating elements.
Figure 3B:
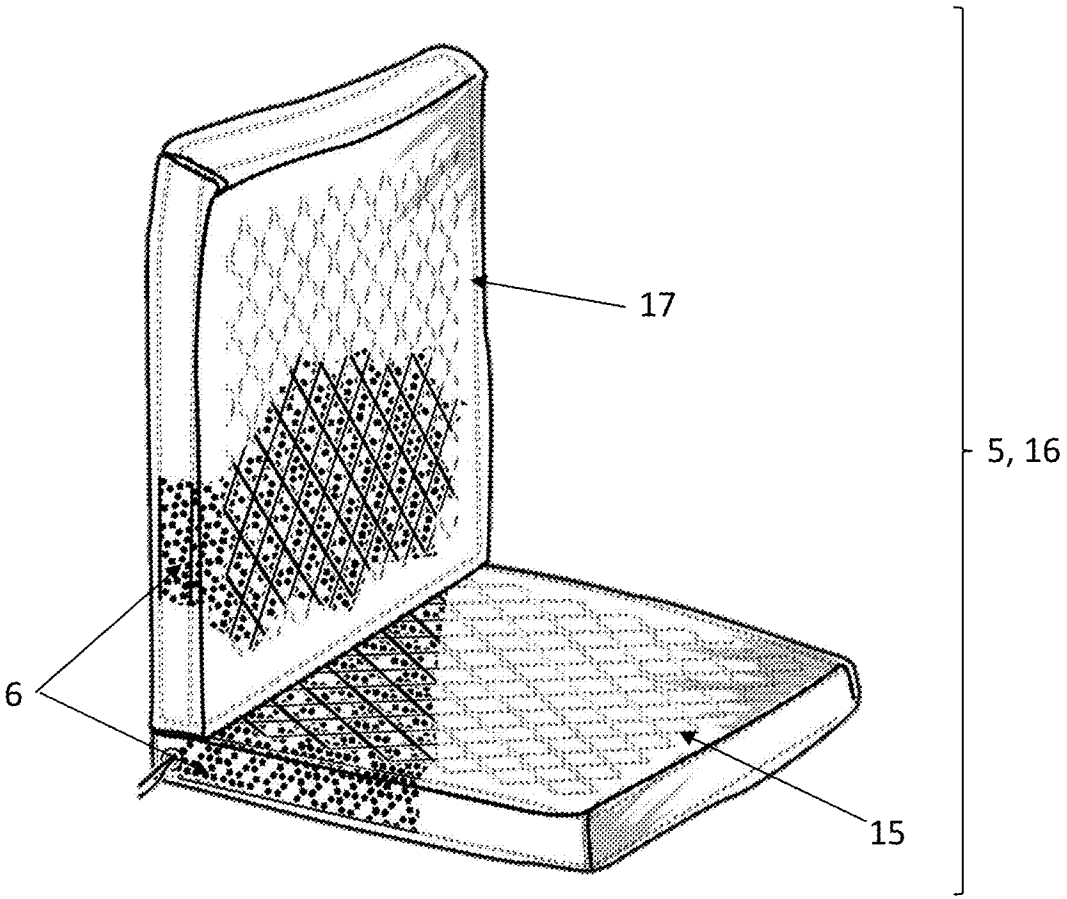
FIG. 3B is a view of the second embodiment of the seat cushion comprising the seat portion and back portion, and also displaying the associated plurality of heating elements.
Figure 3C:
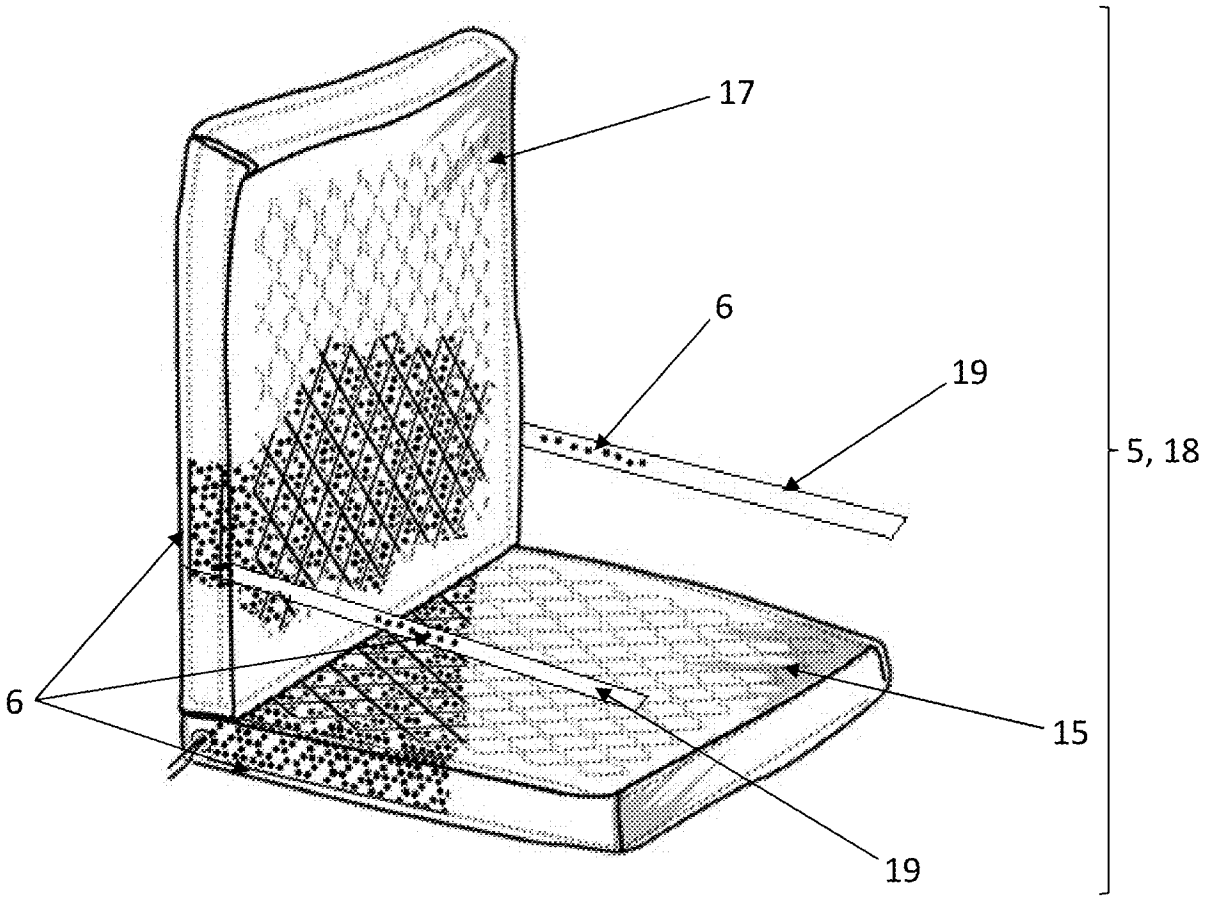
FIG. 3C is a view of the third embodiment of the seat cushion comprising the seat portion, back portion and pair of arm portions, and also displaying the associated plurality of heating elements.
Figure 3D:
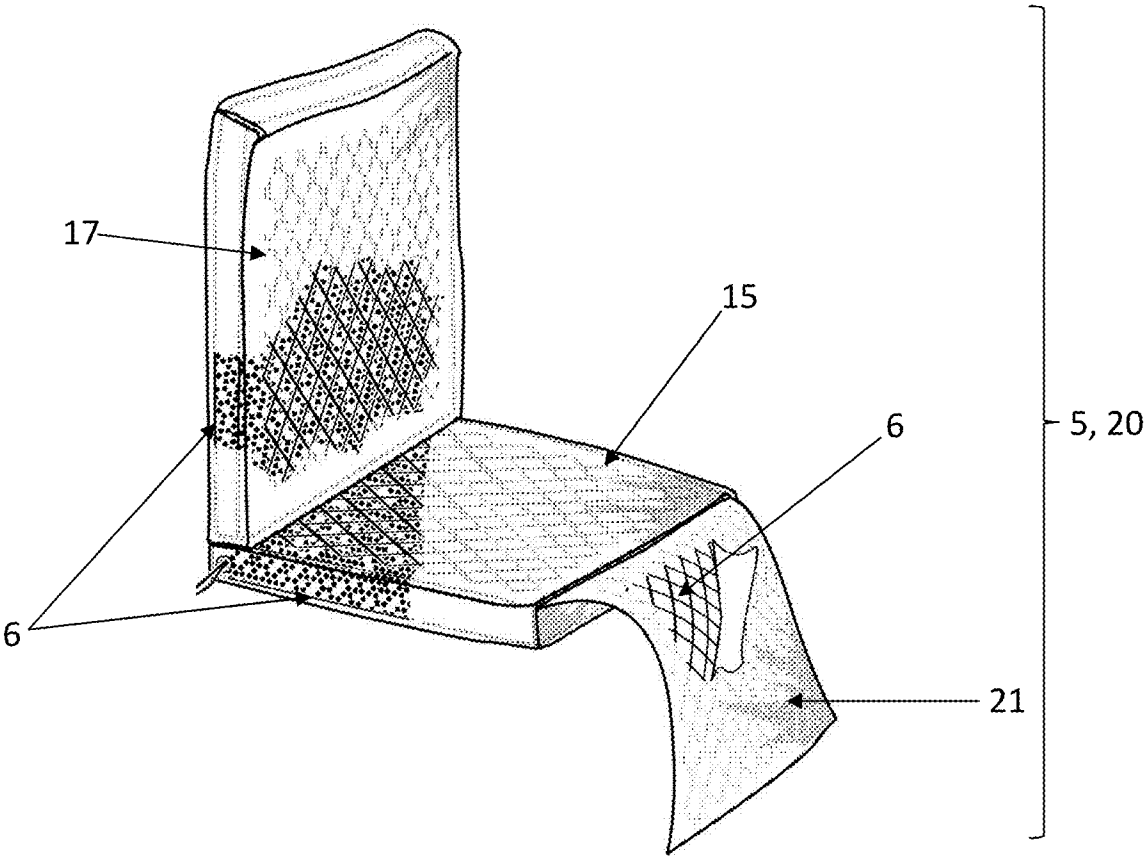
FIG. 3D is a view of the fourth embodiment of the seat cushion comprising the seat portion, back portion and leg portion, and also displaying the associated plurality of heating elements.
Figure 3E:
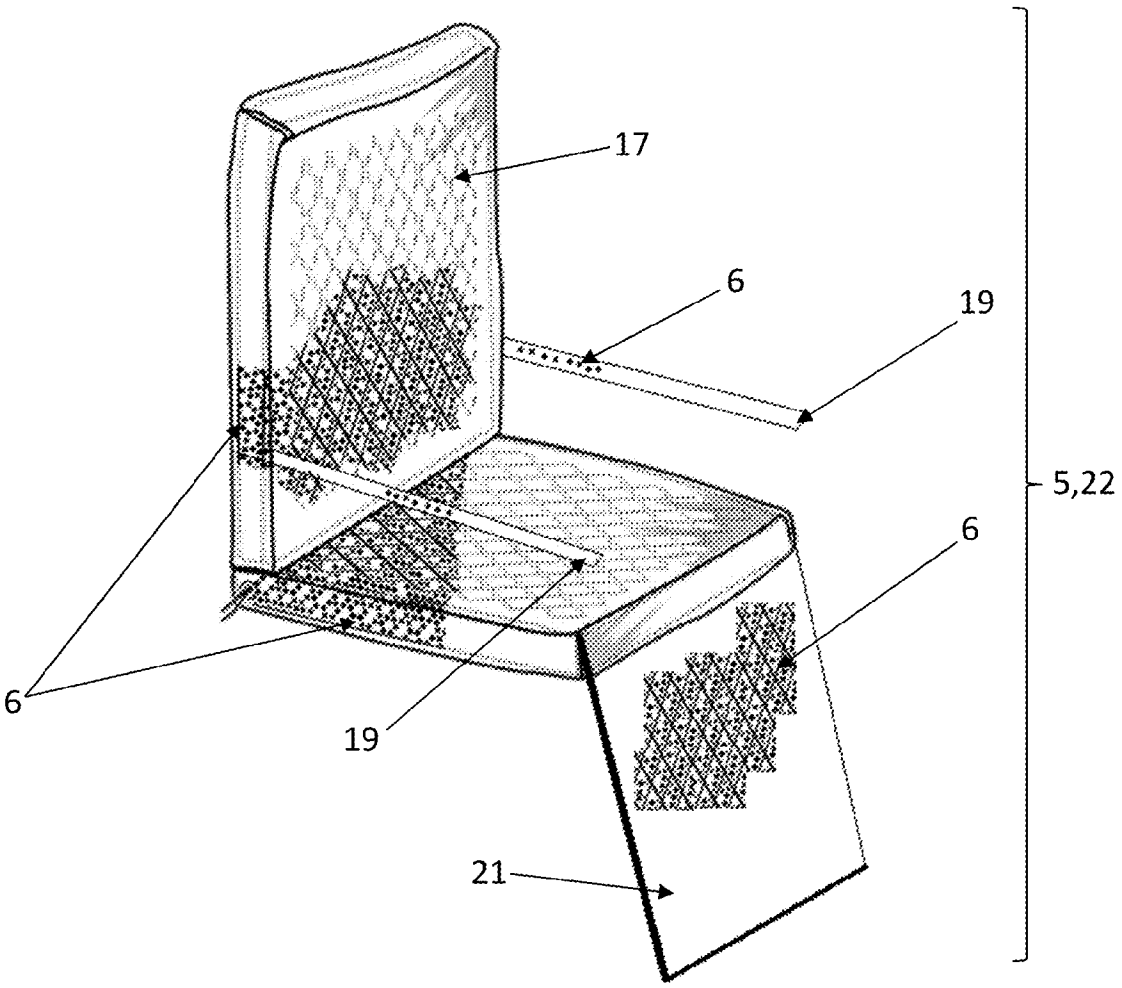
FIG. 3E is a view of the fifth embodiment of the seat cushion comprising the seat portion, back portion, pair of arm portions, and leg portion, and also displaying the associated plurality of heating elements.
Figure 4A:
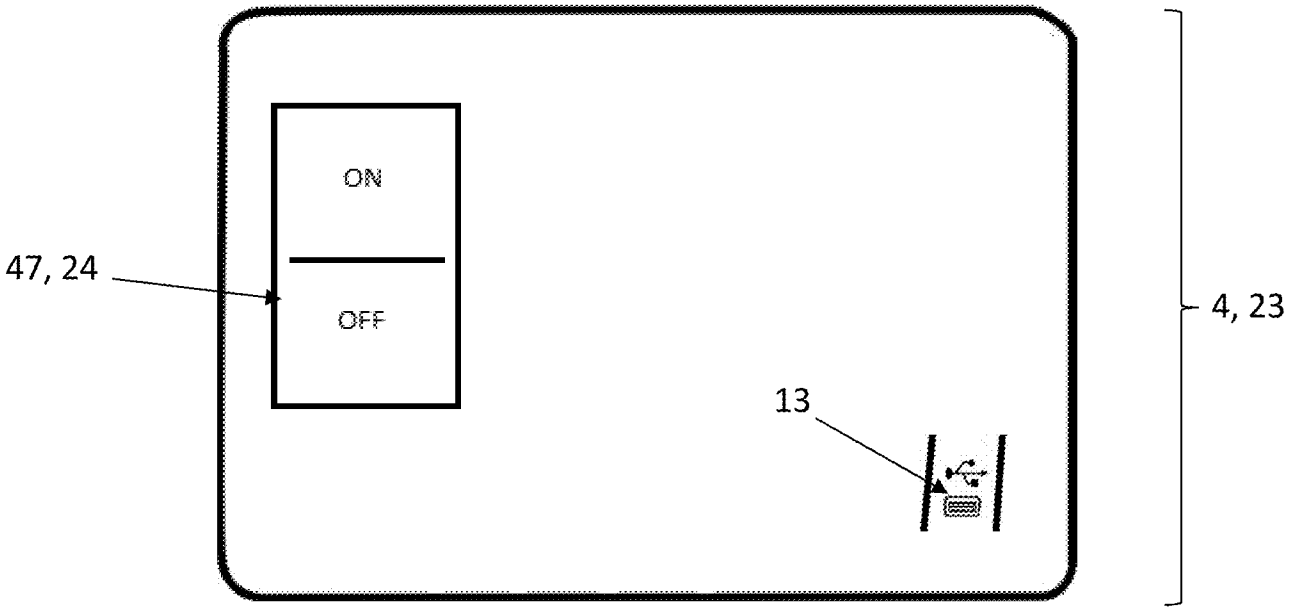
FIG. 4A is a view of the control unit comprising the on/off switch
Figure 4B:
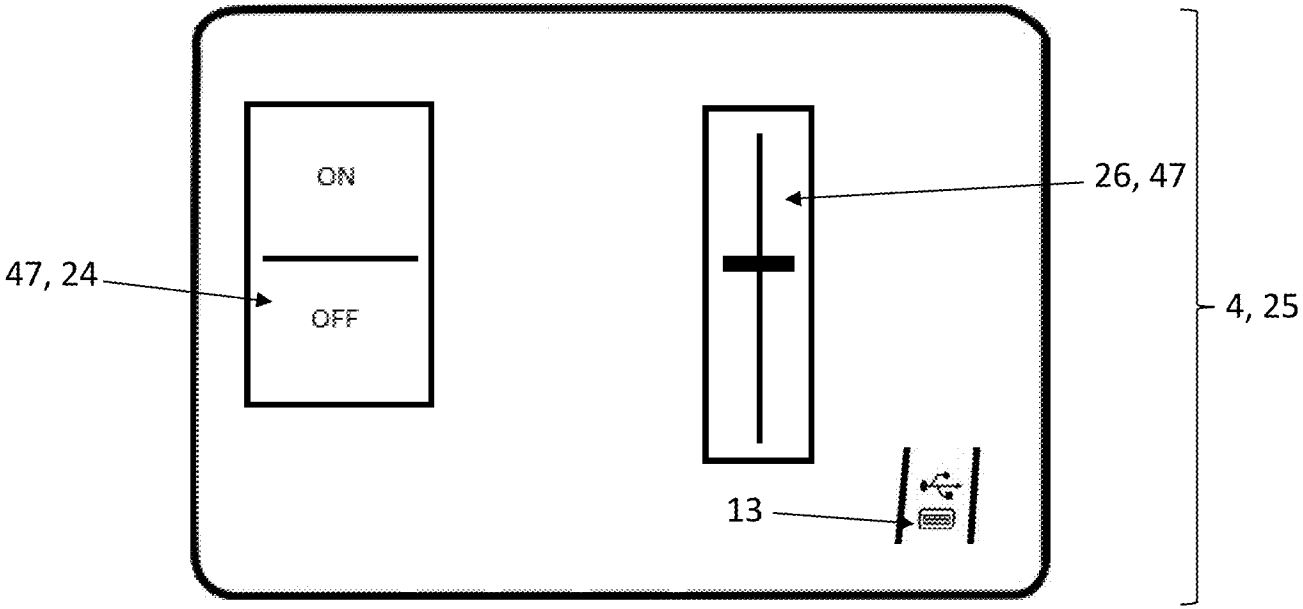
FIG. 4B is a view of the control unit comprising the on/off switch and a plurality of level control switches to control the flow of electricity to the plurality of heating elements.
Figure 4C:
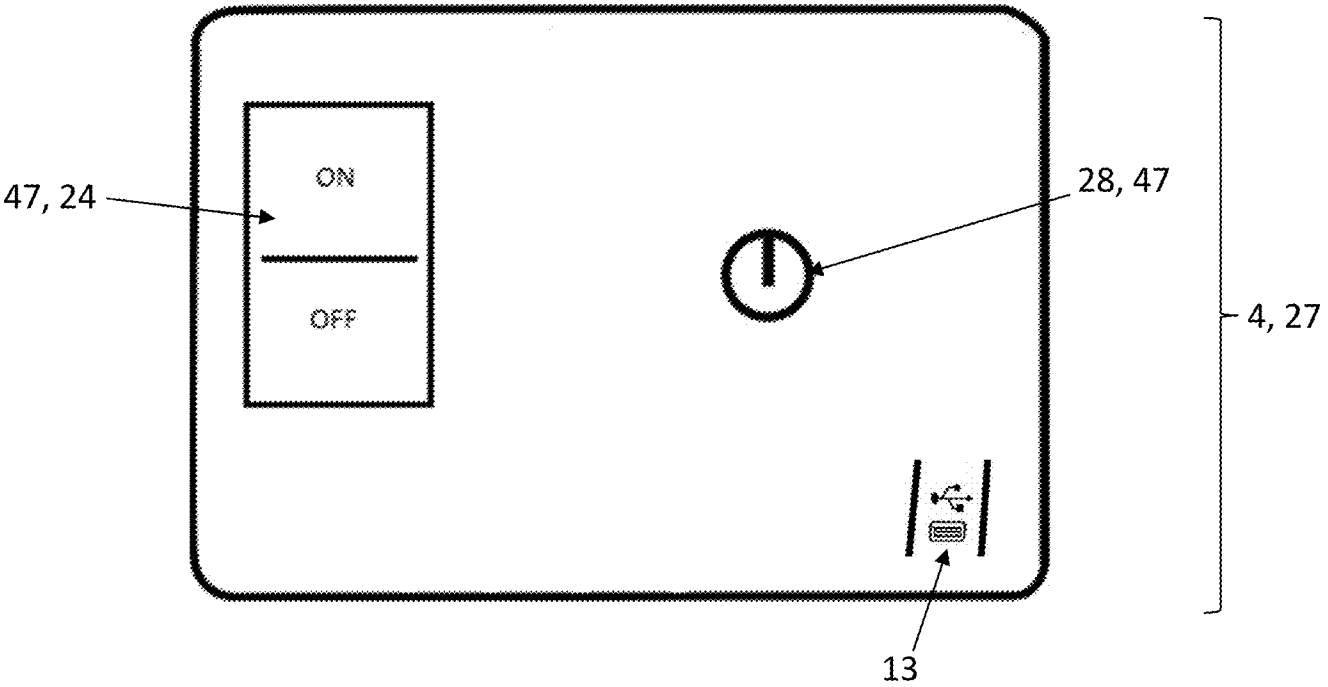
FIG. 4C is a view of the control unit comprising the on/off switch and a rheostat to control the flow of electricity to the plurality of heating elements.
Figure 4D:
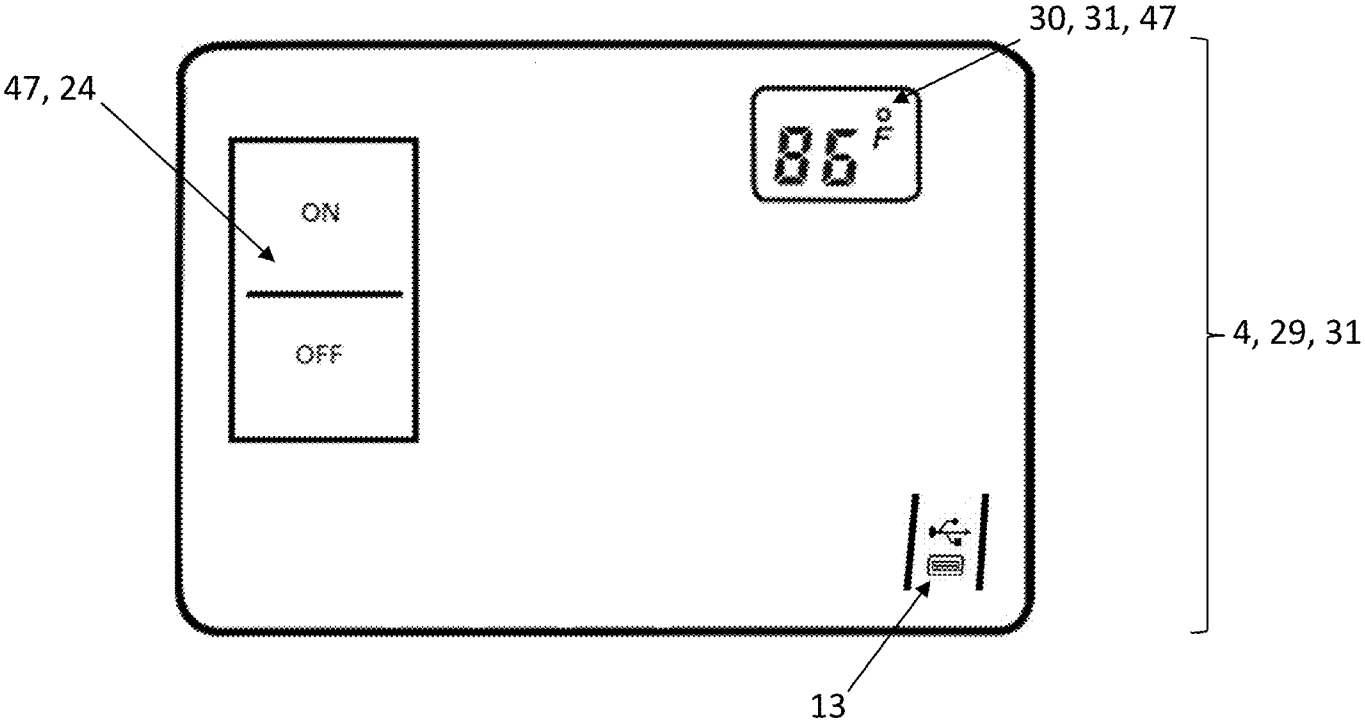
FIG. 4D is a view of the control unit comprising the on/off switch and a temperature monitoring means where the temperature monitoring means is set by the manufacturer and controls the maximum temperature the plurality of heating elements reach before shutting the flow of electricity to the heating elements off and allowing the heating elements to cool, at which time the flow of electricity begins again.
Figure 4E:
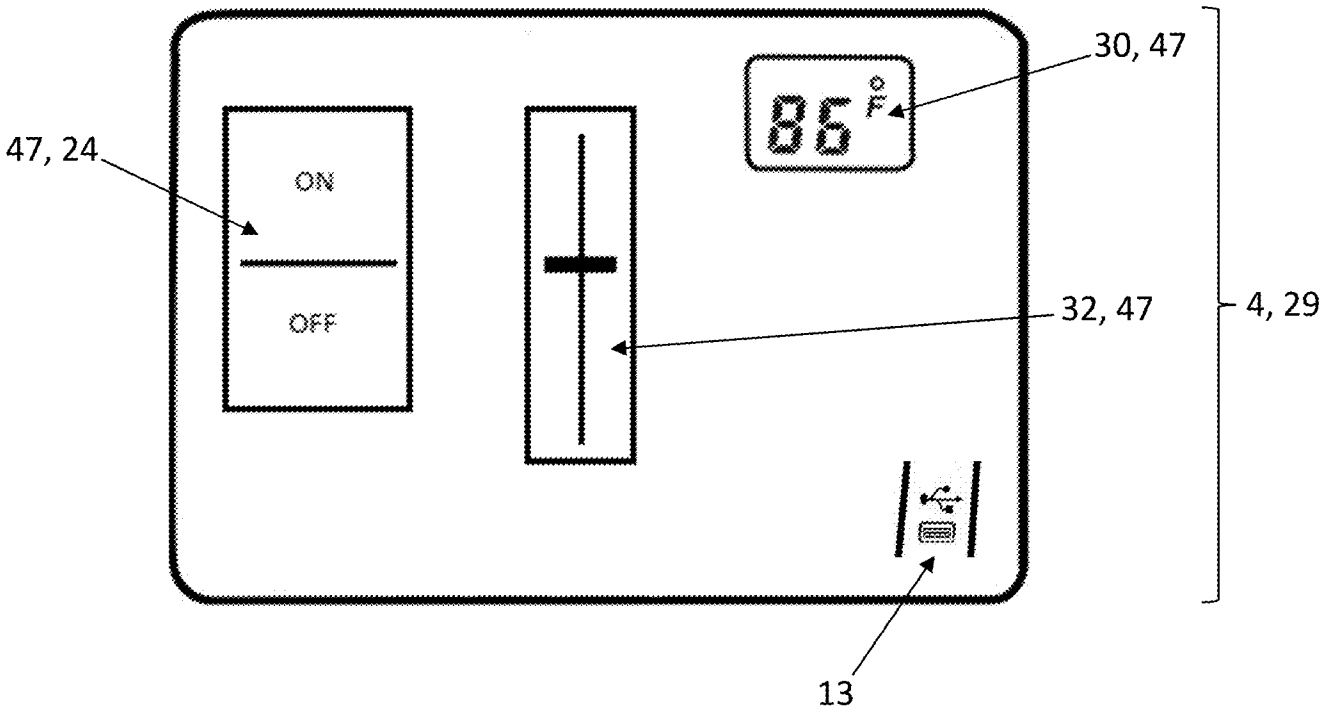
FIG. 4E is a view of the control unit comprising the on/off switch and a temperature monitoring means where the temperature monitoring means is controlled by the operator by means of a plurality of level switches that controls the maximum temperature the plurality of heating elements reach before shutting the flow of electricity to the heating elements off and allowing the heating elements to cool, at which time the flow of electricity begins again.
Figure 4F:
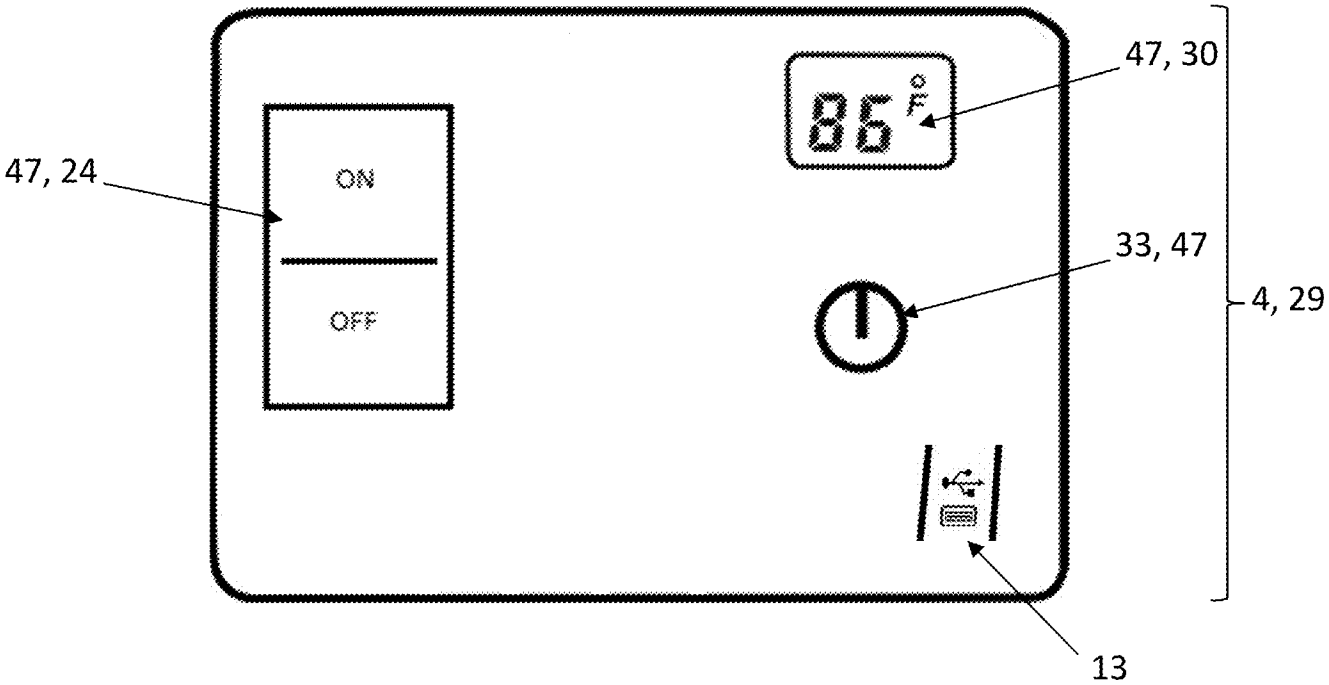
FIG. 4F is a view of the control unit comprising the on/off switch and a temperature monitoring means where the temperature monitoring means is controlled by the operator by means of a rheostat that controls the maximum temperature the plurality of heating elements reach before shutting the flow of electricity to the heating elements off and allowing the heating elements to cool, at which time the flow of electricity begins again.

A portable solar powered heated seat cushion 1 that does not disturb the environment, to be used during activities such but not limited to hunting, fishing and camping, that can be used on any seating surface comprising a plurality of solar panels 2 that convert solar energy to electricity for the powering of the portable solar powered heated seat cushion 1, with or without a power storage device 3 such as a rechargeable battery, where there is also a control unit 4 with a switching means 47 to control the amount of electricity directed through the solar powered heated seat cushion and/or controls the temperature, a portable seat cushion 5 with a plurality of heating elements 6 contained in the portable seat cushion 5, and a plurality of electrical cabling 8 with a plurality of connectors 48 to connect the elements of the solar powered heated seat cushion 1 together and convey electricity, wherein the plurality of connectors 48 may comprise electrical connection methods such as connecting post and nuts, screw connectors, or wire nuts, and wherein a connector set is made up of the plurality of connectors 48 necessary to connect any of the plurality of electrical cabling 8 to any of the other items that make up the portable solar powered heated seat cushion 1.

There are three embodiments of the solar powered heated set cushion 1. In the first embodiment 7 the solar powered heated seat cushion only operates when the sun is out. In the second embodiment 9 of the solar powered heated seated cushion 1, the power storage device 3 is wired in series. In the third embodiment 49 of the solar powered heated seated cushion 1, the power storage device 3 is wired in parallel between the plurality of solar panels 2 and the control unit 4, such that, the source of the electricity is controlled by a power control means 50 and electricity is only supplied from the power storage device 8 to the control unit 4 when the electricity from the plurality of solar panels 2 is insufficient to power plurality of heating elements 6.

The first embodiment 7 of the portable solar powered heated seat cushion 1 comprises a plurality of solar panels 2 that are connected to a control unit 4 by a first electrical cabling 34 of the plurality of electrical cabling 8, wherein there is a first connector set 35 of the plurality of connectors 48, connecting the plurality of solar panels 2 to the first electrical cabling 34 and a second connector set 36 of the plurality of connectors 48 connecting the first electrical cabling 34 to the control unit 4, wherein the control unit 4 is further connected to the plurality of heating elements 6 by a second electrical cabling 37 of the plurality of electrical cabling 8, wherein there is a third connector set 38 of the plurality of connectors 48 connecting the control unit 4 to the second electrical cabling 37 and the cabling is connected to the plurality of heating elements 6 by a fourth connector set 39 of the plurality of connectors 48, wherein the plurality of heating elements 6 are inserted into a seat cushion 5, and wherein solar energy is converted to electricity by the plurality of solar panels 2, the produced electricity travels through the first electrical cabling 34 to reach the control unit 4, the control unit 4 directs the electricity through the second electrical cabling 37 to the plurality of heating elements 6, and the plurality of heating elements 6 convert the electricity to heat in order to provide warmth to the operator while seated.

The second embodiment 9 of the portable solar powered heated seat cushion 1 comprises a plurality of solar panels 2 that are connected to a power storage device 3 by a first electrical cabling 34 of the plurality of electrical cabling 8, wherein there is a first connector 35 of the plurality of connectors 48 connecting the plurality of solar panels 2 to the first electrical cabling 34 and a second connector set 36 of the plurality of connectors 48 connecting the first electrical cabling 34 to the power storage device 3, wherein the power storage device 3 is further connected to the control unit 4 by a second electrical cabling 37 of the plurality of electrical cabling 8, wherein there is a third connector 38 of the plurality of connectors 48 connecting the power storage device 3 to the second electrical cabling 37 and the second electrical cabling 37 is connected to the control unit 4 by a fourth connector 39 of the plurality of connectors 48, wherein the control unit 4 is further connected to the plurality of heating elements 6 by a third electrical cabling 40 of the plurality of electrical cabling 8, wherein there is a fifth connector 41 of the plurality of connectors 48 connecting the control unit 4 to the third electrical cabling 40 and the third electrical cabling 40 is connected to the plurality of heating elements 6 by a sixth connector 42 of the plurality of connectors 48, wherein the plurality of heating elements 6 are inserted into a seat cushion 5, and wherein solar energy is converted to electricity by the plurality of solar panels 2, the produced electricity travels through the first electrical cabling 34 to reach the power storage device 3, the power storage device 3 directs the electricity through the second electrical cabling 37 and to the control unit 4, which controls amount of electricity that flows to the heating elements by means of the switching means 47, the control unit 4 directs the electricity through the third electrical cabling 40 the third electrical cabling 40 is connected to and delivers electricity to the plurality of heating elements 6 within the portable seat cushion 5, and the plurality of heating elements 6 convert the electricity to heat.

The third embodiment 49 of the portable solar powered heated seat cushion 1 comprises a plurality of solar panels 2 that are connected to the power storage device 3 and a power control means 50, such that electricity generated from the plurality of solar panels 2 can be conducted to both to the power storage device 3 and the power control means 50. The power storage device 3 is also connected to the power control means 50, the power control means 50 is connected to the control unit 4 and the control unit 4 is connected to the plurality of heating elements 6 within the portable seat cushion 5. The power control means 50 operates such that when the plurality of solar panels 2 are supplying electricity and the portable solar powered heated seat cushion 1 is off or the amount of electricity being supplied from the plurality of solar panels 2 is in excess of the needs of the plurality of heating elements 6, the electricity from the plurality of solar panels 2 can recharge the power storage device 3, when the portable solar powered heated seat cushion 1 is on the plurality of solar panels 2 can supply electricity directly to the control unit 4 and thus directly to the plurality of heating elements 6, and when the plurality of solar panels 2 are supplying insufficient or no the electricity to the control unit 4 the power control means 50 can supply electricity from the power storage device 3. In this configuration, the plurality of solar panels 2 are connected to a first electrical cabling 34 of the plurality of electrical cabling 8 by a first connector set 35 of the plurality of connectors 48, the first electrical cabling 34 runs from the plurality of solar panels 2 to the power storage device 3 and the power control means 50. A second connector set 36 of the plurality of connectors 48 connects the first electrical cabling 34 to the power storage device 3. A third connector set 38 of the plurality of connectors 48 connects the first electrical cabling 34 to the power control means 50. A second electrical cabling 37 of the plurality of electrical cabling 8 connects the power storage device 3 to the power control means 50 wherein there is a fourth connector set 39 of the plurality of connectors 48 connecting the power storage device 3 to the second electrical cabling 37 and a fifth connector set 41 of the plurality of connectors 48 connecting the second electrical cabling 37 to the power control means 50. The power control means 50 operates such that electricity is only drawn from the power storage device 3 to the control unit 4 when the electricity from the plurality of solar panels 2 is insufficient to power the plurality of heating elements 6. The power control means 50 is connected to the control unit 4 by a third electrical cabling 40 of the plurality of electrical cabling 8, wherein there is a sixth connector set 42 of the plurality of connectors 48 connecting the power control device 3 to the third electrical cabling 40 and the third electrical cabling 40 is connected to the control unit 4 by a seventh connector set 43 of the plurality of connectors 48, wherein the control unit 4 is further connected to the plurality of heating elements 6 by a fourth electrical cabling 44 of the plurality of electrical cabling 8, wherein there is a eighth connector set 45 of the plurality of connectors 48 connecting the control unit 4 to the fourth electrical cabling 44 and the fourth electrical cabling 44 is connected to the plurality of heating elements 6 by a ninth connector set 46 of the plurality of connectors 48, wherein the plurality of heating elements 6 are inserted into a portable seat cushion 5. Thus solar energy is converted to electricity by the plurality of solar panels 2, the produced electricity travels through the first electrical cabling 34 to reach power storage device 3 and the power control means 50, the power storage device 3 is also connected to the power control means 50, the power control means is then connected to the control unit 4 and the power control means 50 controls the flow of electricity from the plurality of solar panels 2 and the power storage device 3, the control unit 4 directs the electricity through the fourth electrical cabling 44 to the plurality of heating elements 6, and the plurality of heating elements 6 convert the electricity to heat in order to provide warmth.

In the first embodiment 7 of the portable solar powered heated seat cushion 1, the second embodiment 9 of the portable solar powered heated seat cushion 1, or the third embodiment 49 of the portable solar powered heated seat cushion 1, the portable seat cushion 5 possesses five embodiments. The first embodiment 14 of the portable seat cushion 5 for the portable solar powered heated seat cushion 1 comprises a seat portion 15. A second embodiment 16 of the seat cushion 5 comprises a seat portion 15 and a back portion 17. A third embodiment 18 of the seat cushion 5 comprises a seat portion 15, a back portion 17 and a pair of arm portions 19. A fourth embodiment 20 of the seat cushion 5 comprises a seat portion 15, a back portion 17, and a leg portion 21. A fifth embodiment 22 of the seat cushion 5 comprises a seat portion 15, a back portion 17, a pair of arm portions 19, and a leg portion 21. Within the seat cushion 5, the seat portion 15, back portion 17, pair of arm portions 19, and leg portion 21 each contain a plurality of heating elements 6.

In either the first embodiment 7 of the portable solar powered heated seat cushion 1, the second embodiment 9 of the portable solar powered heated seat cushion 1, or the third embodiment 49 of the portable solar powered heated seat cushion 1, the switching means 47 of the control unit 4 possesses four embodiments. The first embodiment 23 of the switching means 47 comprises an on/off switch 24. A second embodiment 25 of the switching means 47 comprises an on/off switch 24 and a plurality of level control switches 26, for instance, a low, medium and high, where the plurality of level control switches 26 regulate the flow of electricity to the plurality of heating elements 6. A third embodiment 27 of the switching means 47 comprises an on/off switch 24 and a rheostat 28 where the rheostat 28 regulates the flow of electricity to the plurality of heating elements 6. A fourth embodiment 29 of the switching means 47 comprises an on/off switch 24 and a temperature monitoring means 30 connected to a temperature sensor 97 located in the seat cushion, where the temperature monitoring means 30 allows the plurality of heating elements 6 to reach a maximum temperature before shutting off the electricity to the plurality of heating elements 6 and allowing the plurality of heating elements 6 to cool before reactivating the flow of electricity to the plurality of heating elements 6, where the temperature monitoring means 30 can be either a range of allowable temperatures preset by the manufacturer 31 or manually controlled by the operator through a plurality of temperature control level switches 32 or a temperature control rheostat 33.

In any of the embodiments of the control unit 4, the control unit 4 may possess a plurality of additional power outlets 13, such as a usb port.

What is claimed:

1. A portable solar powered heated seat cushion that can be placed on any seat or surface and provide warmth to user for an extended period of time without disturbing the surroundings wherein solar panels convert sunlight to electricity in order to power heating elements contained within a portable seat cushion comprising a plurality of solar panels, a control unit, a plurality of heating elements, a portable seat cushion, and a plurality of electrical cabling with a plurality of connectors;

wherein the plurality of electrical cabling connect the plurality of solar panels to the control unit and the control unit to the plurality of heating elements such that there is a first connector set of the plurality of connectors that connects the plurality of solar panels to a first electrical cabling of the plurality of electrical cabling, there is a second connector set of the plurality of connectors that connects the first electrical cabling to the control unit, there is a third connector set of the plurality of connectors that connects the control unit to a second electrical cabling of the plurality of electrical cabling, and there is a fourth connector set of the plurality of connectors that connects the second electrical cabling to the plurality of heating elements;

wherein the control unit comprises a switching means to regulate the flow of electricity to the solar cells; and wherein the plurality of heating elements are inserted into the seat cushion to provide warmth to the operator while seated.

2. The portable solar powered heated seat cushion claim 1 wherein the switching means of the control unit comprises at least one of an on/off switch, a plurality of level control switches, a rheostat or a temperature monitoring means.

3. The portable solar powered heated seat cushion of claim 2, wherein the temperature monitoring means comprising at least one of, a range of allowable temperatures preset by the manufacturer, a plurality of temperature control level switches, or a temperature control rheostat;

wherein the temperature monitoring means further comprises a temperature sensor in the seat cushion to monitor the temperature of the seat cushion in order to regulate the flow of electricity relative to the sensed temperature; and wherein the second electrical cabling contains cabling to connect the control unit to the temperature monitoring means so as to facilitate the flow of electricity to the plurality of heating elements.

4. The portable solar powered heated seat cushion of claim 1, 2 or 3 wherein the seat cushion comprises at least one of a seat portion, back portion, pair of arm portions, or leg portion.

5. A portable solar powered heated seat cushion that can be placed on any seat or surface and provide warmth to user for an extended period of time without disturbing the surroundings wherein solar panels convert sunlight to electricity in order to power heating elements contained within a seat cushion comprising a plurality of solar panels, a power storage device, a control unit, a plurality of heating elements, a portable seat cushion, and a plurality of electrical cabling with a plurality of connectors;

where the plurality of electrical cabling connect the plurality of solar panels to the a power storage device, the power storage device to the control unit and the control unit to the plurality of heating elements such that there is a first connector set of the plurality of connectors that connects the plurality of solar panels to a first electrical cabling of the plurality of electrical cabling, there is a second connector set of the plurality of connectors that connects the first electrical cabling to the power storage device, there is a third connector set of the plurality of connectors that connects the power storage device to a second electrical cabling of the plurality of electrical cabling, there is a fourth connector set of the plurality of connectors that connects the second electrical cabling to the control unit, there is a fifth connector set of the plurality of connectors that connects the control unit to a third electrical cabling of the plurality of electrical cabling, and there is a sixth connector set of the plurality of connectors that connects the third electrical cabling to the plurality of heating elements;

wherein the control unit comprises a switching means to regulate the flow of electricity to the solar cells; and where the plurality of heating elements are inserted into the seat cushion to provide warmth to the operator while seated.

6. The portable solar powered heated seat cushion of claim 5 wherein the switching means of the control unit comprises at least one of an on/off switch, a plurality of level control switches, a rheostat or a temperature monitoring means.

7. The portable solar powered heated seat cushion of claim 6, wherein the temperature monitoring means comprises at least one of, a range of allowable temperatures preset by the manufacturer, a plurality of temperature control level switches, or a temperature control rheostat;

wherein the temperature monitoring means further comprises a temperature sensor in the seat cushion to monitor the temperature of the seat cushion in order to regulate the flow of electricity relative to the sensed temperature; and wherein the third electrical cabling contains cabling to connect the control unit to the temperature monitoring means so as to facilitate the flow of electricity to the plurality of heating elements.

8. The portable solar powered heated seat cushion of claim 5, 6 or 7 wherein the seat cushion comprises at least one of a seat portion, back portion, pair of arm portions, or leg portion.

9. A portable solar powered heated seat cushion that can be placed on any seat or surface and provide warmth to user for an extended period of time without disturbing the surroundings wherein solar panels convert sunlight to electricity in order to power heating elements contained within a seat cushion comprising a plurality of solar panels, a power storage device, a control unit, a plurality of heating elements, a portable seat cushion, and a plurality of electrical cabling with a plurality of connectors;

where the plurality of electrical cabling connect the plurality of solar panels to the a power storage device and a power control means, the power storage device is also connected to the power control means, the power control means to the control unit and the control unit to the plurality of heating elements such that there is a first connector set of the plurality of connectors that connects the plurality of solar panels to a first electrical cabling of the plurality of electrical cabling, there is a second connector set of the plurality of connectors that connects the first electrical cabling to the power control means, there is a third connector set of the plurality of connectors that connects the first electrical cabling to the power storage device, there is a fourth connector set of the plurality of connectors that connects the power storage device to a second electrical cabling of the plurality of electrical cabling, there is a fifth connector set of the plurality of connectors that connects the second electrical cabling to the power control means, there is a sixth connector set of the plurality of connectors that connects the power control means to the third electrical cabling of the plurality of electrical cabling, there is a seventh connector set of the plurality of connectors that connects the third electrical cabling to the control unit, there is a eighth connector set of the plurality of connectors that connects the control unit to a fourth electrical cabling of the plurality of electrical cabling, and there is a ninth connector set of the plurality of connectors that connects the fourth electrical cabling to the plurality of heating elements;

wherein the control unit comprises a switching means to regulate the flow of electricity to the solar cells; and where the plurality of heating elements are inserted into the seat cushion to provide warmth to the operator while seated.

10. The portable solar powered heated seat cushion of claim 9 wherein the control unit comprises at least one of an on/off switch, a plurality of level control switches, a rheostat or a temperature monitoring means.

11. The portable solar powered heated seat cushion of claim 10, wherein the temperature monitoring means comprises at least one of, a range of allowable temperatures preset by the manufacturer, a plurality of temperature control level switches, or a temperature control rheostat.

12. The portable solar powered heated seat cushion of claim 9, 10, or 11 wherein the seat cushion comprises at least one of a seat portion, back portion, pair of arm portions, or leg portion.

* * * * *